US008772661B2

(12) United States Patent
Liang et al.

(10) Patent No.: US 8,772,661 B2
(45) Date of Patent: Jul. 8, 2014

(54) PRESS BUTTON AND PORTABLE COMPUTER USING THE SAME

(75) Inventors: Chen-Yi Liang, New Taipei (TW); Cheng-Hsiang Chuang, New Taipei (TW); Chun-Chien Chen, New Taipei (TW); Shun-De Bai, New Taipei (TW); San-Pao Kao, New Taipei (TW)

(73) Assignee: Wistron Corp., New Taipei (TW)

( * ) Notice: Subject to any disclaimer, the term of this patent is extended or adjusted under 35 U.S.C. 154(b) by 282 days.

(21) Appl. No.: 13/354,279

(22) Filed: Jan. 19, 2012

(65) Prior Publication Data

US 2012/0250234 A1 Oct. 4, 2012

(30) Foreign Application Priority Data

Mar. 30, 2011 (TW) ..... 100205598 U

(51) Int. Cl.
*H01H 13/70* (2006.01)

(52) U.S. Cl.
USPC ..... 200/345; 200/344; 200/341

(58) Field of Classification Search
CPC ..... H01H 13/70
USPC ..... 200/341–345
See application file for complete search history.

(56) References Cited

U.S. PATENT DOCUMENTS

| | | | | |
|---|---|---|---|---|
| 5,466,901 | A | 11/1995 | Mochizuki | |
| 5,914,468 | A * | 6/1999 | Nishimura et al. | 200/5 A |
| 5,941,372 | A * | 8/1999 | Johnston | 200/343 |
| 6,100,482 | A * | 8/2000 | Koma et al. | 200/344 |
| 6,150,624 | A | 11/2000 | Yao | |
| 6,509,536 | B2 * | 1/2003 | Sasaki | 200/344 |
| 6,940,030 | B2 * | 9/2005 | Takeda et al. | 200/343 |
| 2012/0228107 | A1 * | 9/2012 | Funakoshi et al. | 200/532 |

OTHER PUBLICATIONS

US Patent Office, Office Action, U.S. Appl. No. 13/327,772, filed Dec. 6, 2013, US.

* cited by examiner

*Primary Examiner* — Renee S Luebke
*Assistant Examiner* — Ahmed Saeed

(57) ABSTRACT

A thin press button is provided. The press button includes a base plate, a link member, a cap, and at least one stopper. The link member, having a sliding recess, is disposed on the base plate. The cap pivots on the link member. The stopper has a first end and a second end, wherein the first end pivots on the cap and the second end is slidably disposed in the sliding recess.

19 Claims, 8 Drawing Sheets

PRESS BUTTON AND PORTABLE COMPUTER USING THE SAME

CROSS REFERENCE TO RELATED APPLICATIONS

This Application claims priority of Taiwan Patent Application No. 100205598, filed on Mar. 30, 2011, the entirety of which is incorporated by reference herein

BACKGROUND OF THE INVENTION

1. Field of the Invention

The invention relates to a press button, and more particularly, to a flat press button.

2. Description of the Related Art

Press buttons are commonly used in nearly every electronic device, such as a portable personal computer. Since size reduction is a trend for the portable personal computer, every element disposed in the portable personal computer must be flat and light. A significant portion of the thickness and weight of the portable personal computer resides in the press button.

Please refer to FIG. 1, wherein a conventional press button 1 is shown. The conventional press button 1 comprises a cap 10, two posts 20 and 30, and a button base 40. The two posts 20 and 30 pivot to each other in a scissors-like manner. Each ends of the two posts 20 and 30 has a circular protrusion 21 and 31, and the cap 10 and the button base 40 have bores 11 and 41, wherein the circular protrusions 21 and 31 are received in the bores 11 and 41. Therefore, the cap 10 is supported on the button base 40 by the posts 20 and 30, and the cap 10 is allowed to move vertically relative to the button base 40.

However, such a scissors-like mechanism requires combining many components which complicates assembly operations. Furthermore, while moving, the large moving profile, required of the cap, is contrary to requirements for thin electronic devices. Thus, a low profile press button mechanism design is seriously desired.

BRIEF SUMMARY OF THE INVENTION

Accordingly, an objective of the present invention is to provide a press button which has a reduced movement profile when operating in a pivotal swinging manner, to decrease a thickness of the press button.

To achieve the above objective, a press button is provided. The press button includes a base plate, a link member, a cap, and at least one stopper. The link member, having a sliding recess, is disposed on the base plate. The cap pivots on the link member. The stopper has a first end and a second end, wherein the first end pivots on the cap and the second end is slidably disposed in the sliding recess.

Another objective of the present invention is to provide a portable computer. The portable computer includes a housing, a control unit, and a press button. The control unit is connected to the housing, and the press button is disposed on the control unit. The press button includes a base plate, a link member, a cap, and at least one stopper. The link member, having a sliding recess, is disposed on the base plate. The cap pivots on the link member. The stopper has a first end and a second end, wherein the first end pivots on the cap and the second end is slidably disposed in the sliding recess.

The press button of the present invention is operated in a pivotal swinging manner to replace the conventional press button which is moved vertically, so that a reduction of thickness is realized.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims In the conventional technology, an assembly operation of a press button is complicated due to complex structures, and a movement profile of the press button is too large resulting in hindrance when further decreasing the thickness of the press button. Therefore, for reducing the thickness of the press button, the present invention provides a flat press button.

Figure 1:
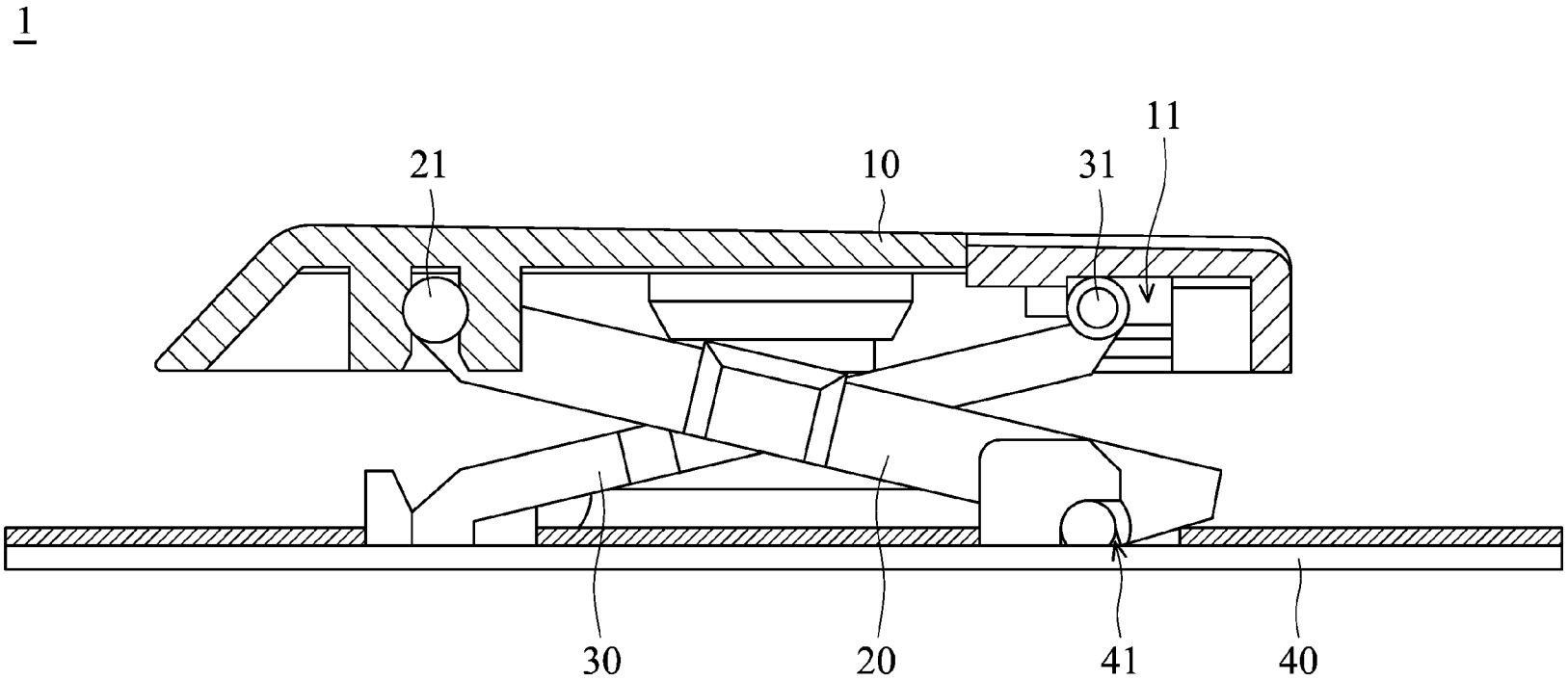
FIG. 1 ( PRIOR ART )
FIG. 1 depicts a cross-sectional view of a conventional press button.
Figure 2:
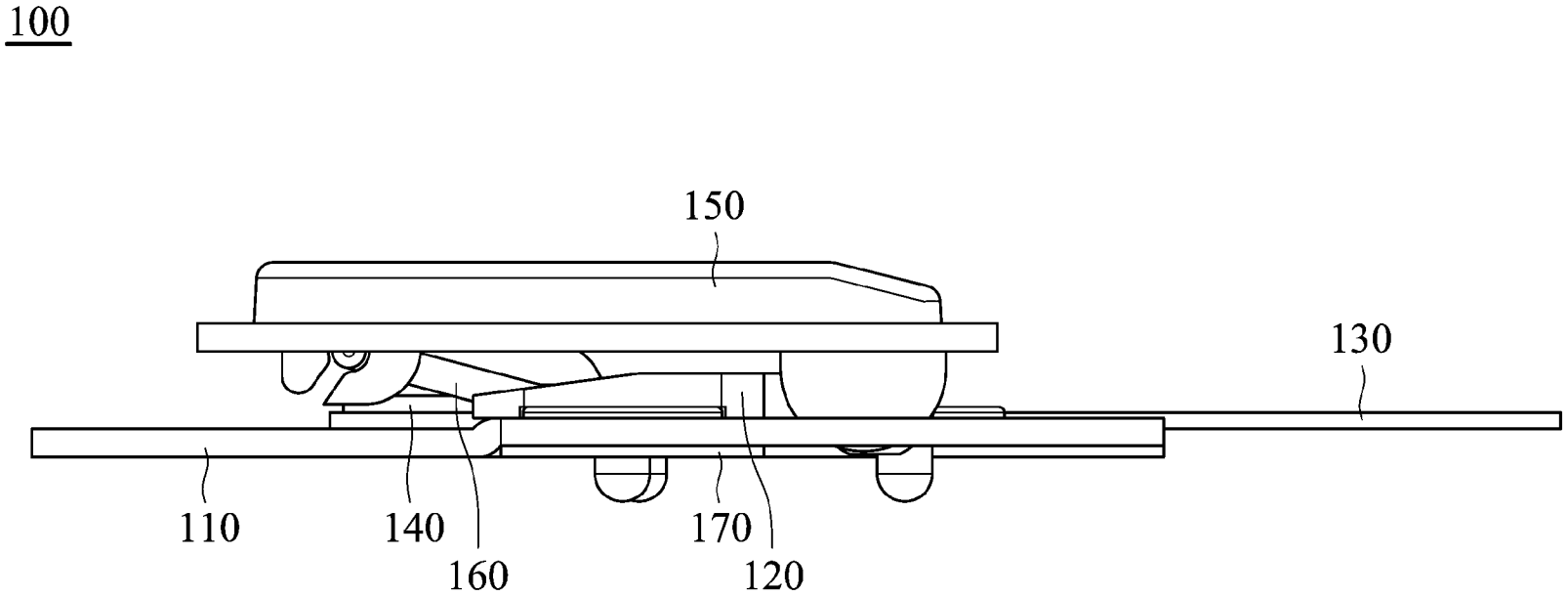
FIG. 2 depicts a side view of the press button in accordance with an embodiment of the invention.

Referring to FIG. 2, the press button 100 of the present invention includes a base plate 110, a link member 120, a circuit board 130, a resilient member 140, a cap 150, two stoppers 160, and two mylar layers 170.

Figure 3A:
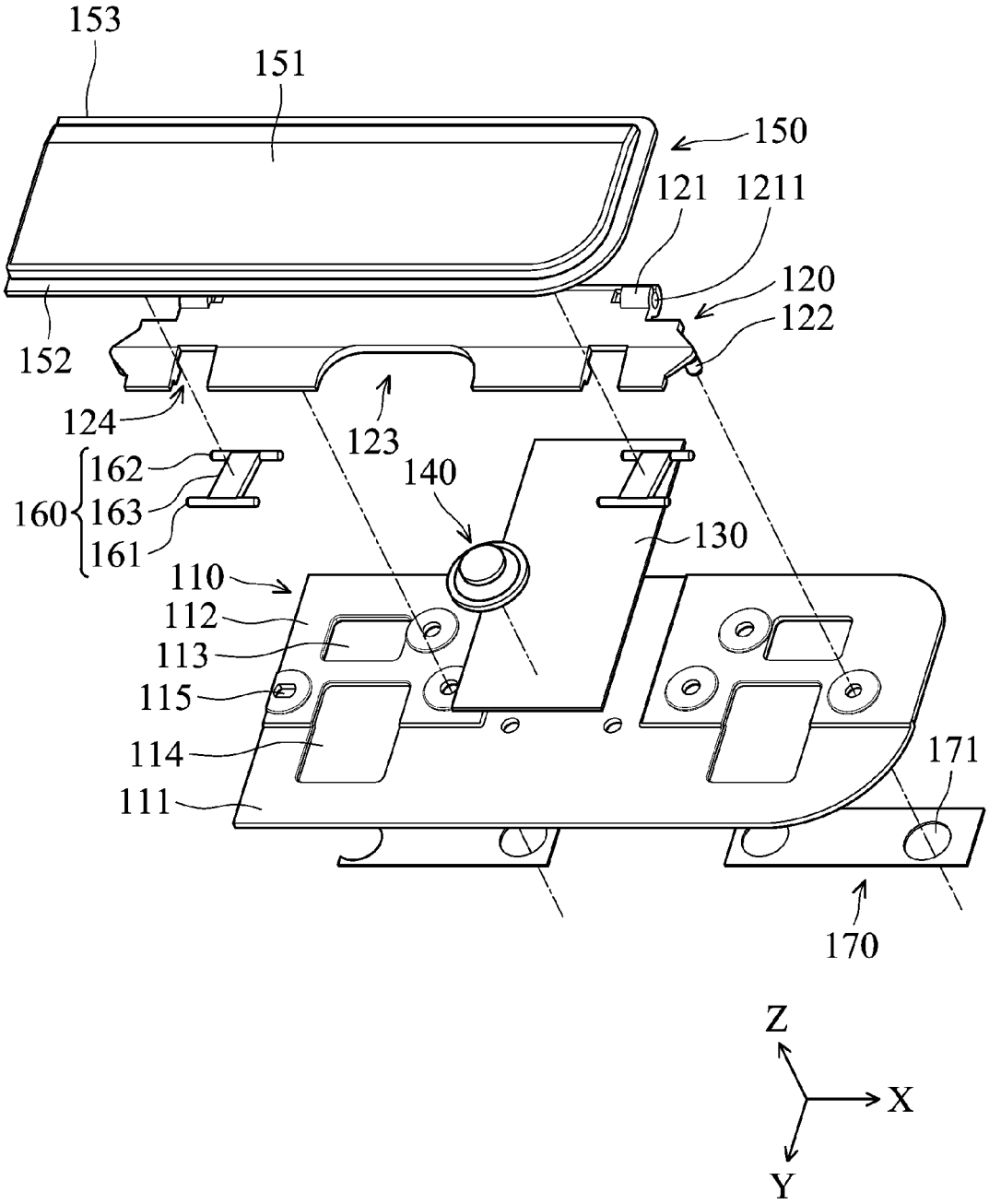
FIG. 3A is an explosive view of the press button in accordance with an embodiment of the invention.
Figure 3B:
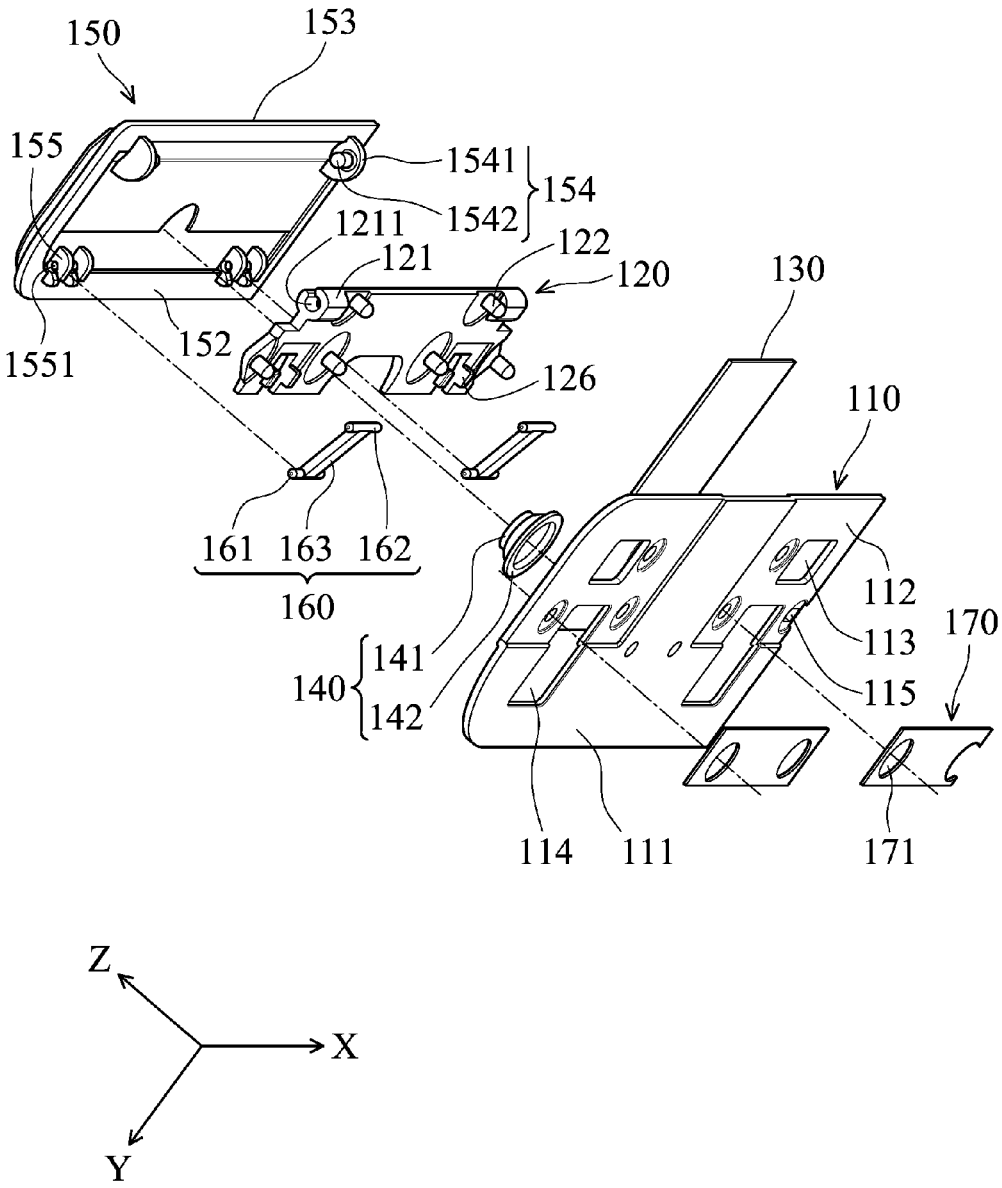
FIG. 3B is an explosive view of the press button in accordance with an embodiment of the invention.
Figure 4A:
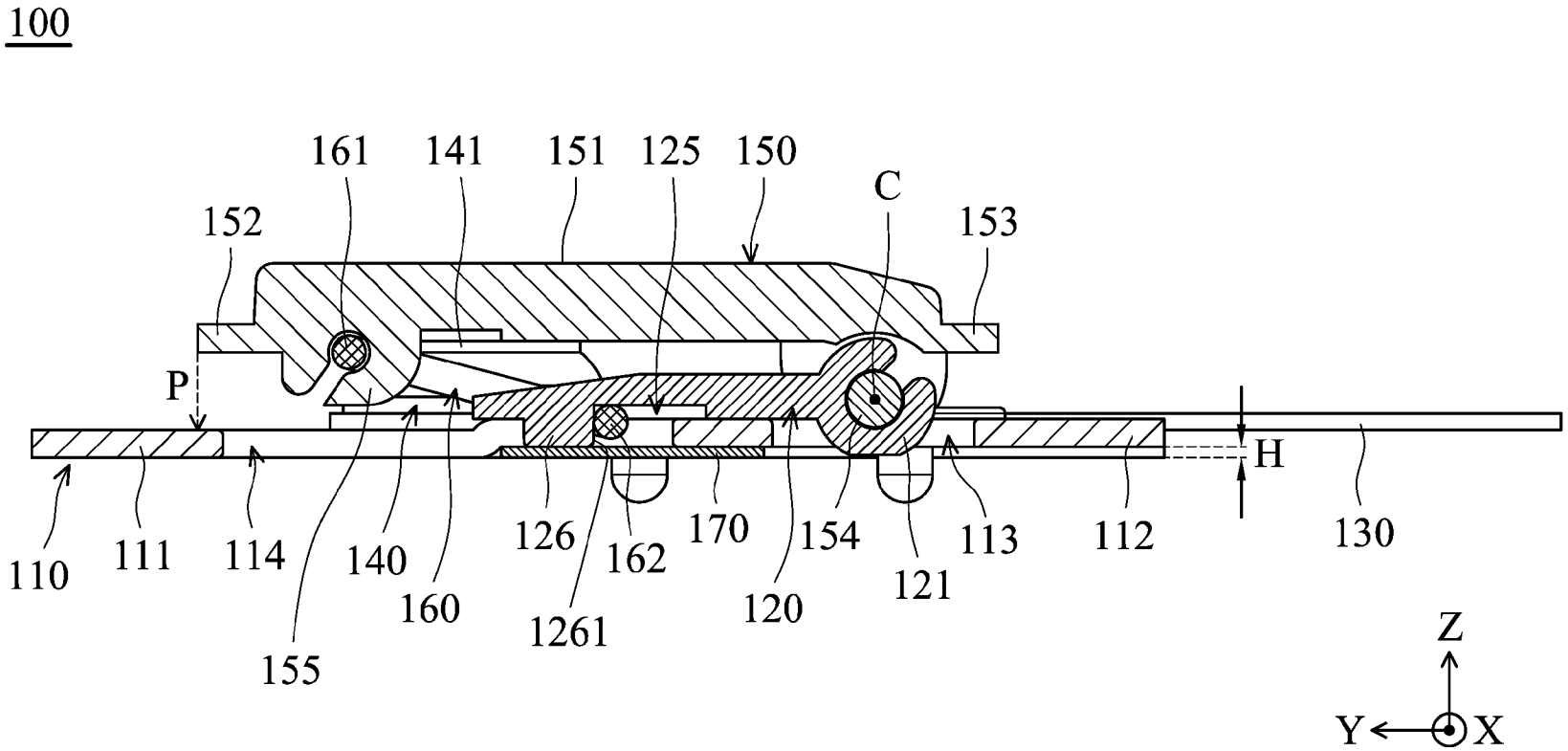
FIG. 4A is a cross-sectional view in accordance with an embodiment of the invention before the press button is pressed.
Figure 5:
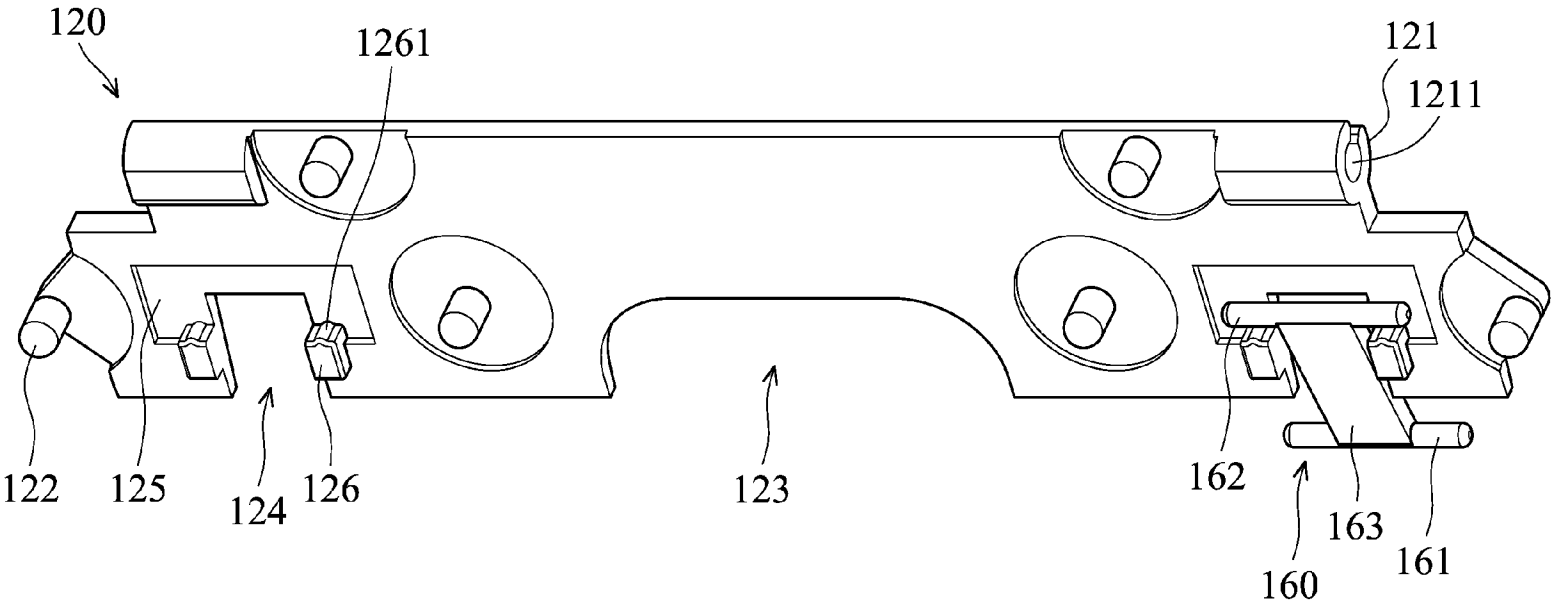
FIG. 5 illustrates a schematic view of the link member in accordance with an embodiment of the invention.

Referring to FIGS. 3A, 3B, 4A and 5, wherein FIG. 5 illustrates a schematic view of partial components in accordance with an embodiment of the invention, and for the purpose of illustration, only the link member 120 and one of the stoppers 160 are shown. In this embodiment, the base plate 110 is a metal member and includes a first region 111, two second regions 112, two first through holes 113, two second through holes 114, and a plurality of positioning holes 115. The second regions 112 are connected to the first region 111 and are embossed from the first region 111. Thus, a height difference H, as shown in FIG. 4A, is defined between the first region 111 and the two second regions 112. The two first through holes 113 and the three positioning holes 115 penetrate surfaces of the two second regions 112. In addition, at a connection region between the first region 111 and each of the two second regions 112, the two second through holes 114 penetrates therethrough.

The link member 120 is made of a plastic material and includes two pivot holders 121, a plurality of positioning pins 122, an opening 123, two channels 124, two sliding recesses 125, and four retaining blocks 126. The pivot holders 121 are substantially C-shaped, and corresponding to the first through holes 113 formed at one side of the link member 120, wherein each of the pivot holders 121 has a bore 1211. It is noted that a part of each of the pivot holders 121 is received in the first through holes 113 of the base plate 110 to reduce the thickness of the press button 100. The positioning pins 122 associated with the positioning holes 115 are formed at the bottom side of the link member 120. Through the connection of the positioning pins 122 and the positioning holes 115, the link member 120 is disposed on the two second regions 112 of the base plate 110 by thermoplastic adhesive techniques. In this embodiment, the bottom surface of the link member 120 is defined at a surface which faces the base plate 110. Additionally, at a side of the link member 120 opposing the side where the pivot holder 121 is disposed, an opening 123 is formed.

Referring to FIG. 5, relative to the same side where the opening 123 is formed, the two channels 124 are formed at the link member 120, wherein the two channels 124 are formed in the left and right sides of the opening 123. In other word, the two channels 124 exhibit generally a rectangular configuration, and penetrate the link member 120 at the side opposing the side where the pivot holder 121 is disposed. Adjacent to the two channels 124, the two sliding recesses 125 are respectively formed at the bottom surface of the link member 120. Corresponding to an outward direction of the two channels 124 and adjacent to the two channels 124 and the two sliding recesses 125, the retaining blocks 126 are disposed on the bottom surface of the link member 120 in pairs, wherein a side 1261 of each of the retaining blocks 126 faces the sliding recesses 125. It is noted that, the width of each of the sliding recesses 125 is larger than the width of each of the channels 124.

Refer to FIGS. 3A, 3B and 4A. The circuit board 130 is sandwiched between the link member 120 and the base plate 110 and is disposed on the surface of the first region 111. In this embodiment, the circuit board 130 is a flexible print circuit board, which is able to detect a pressing movement and further produce a digital signal.

The resilient member 140 is substantially a semi-circular sphere and has an upper portion 141 and lower portion 142, wherein the upper portion 141 protrudes from the lower portion 142. Associated with the opening 123, the lower portion 142 of the resilient member 140 is adhesively disposed on the circuit board 130. In this embodiment, the resilient member 140 is rubber, but it is not to be limited, as any component which is capable of being reshaped to an original shape after being compressed, can be applied as the resilient member 140 of the invention.

The cap 150 includes a pressing surface 151, a first flange 152, a second flange 153, two pivot members 154, and two stopper holders 155. The pressing surface 151 is defined at the upper surface of the cap 150. The first flange 152 and the second flange 153 are formed at two opposing sides of the cap 150. In this embodiment, the two sides of the cap 150 where the first flange 152 and the second flange 153 are formed are substantially parallel to the side of the link member 120 where the pivot holder 121 is formed.

Associated with the pivot holders 121 and adjacent to the second flange 152, the two pivot members 154 are disposed on the bottom surface of the cap 150. Each of the pivot members 154 has a retaining plate 1541 and a pivot pin 1542. The retaining plates 1541 respectively face the outer surfaces of the pivot holders 121. The pivot pins 1542 are associated with the bores 1211 of the pivot holders 121 and are formed at the inner surfaces of the retaining plates 1541. Corresponding to the second through holes 114 of the first region 111 and adjacent to the first flange 152, the two stopper holders 155 are disposed on the bottom surface of the cap 150, wherein each of the stopper holders 155 has a bore 1551.

Each of the stoppers 160 has a first end 161, a second end 162, and a main body 163, wherein the main body 163 is connected to the first end 161 and the second end 162. The first end 161 and the second end 162 respectively protrude from two sides of the main body 163, thus the stopper 160 is substantially I-shaped. In addition, the width of the main body 163 is slightly smaller than the width of the channel 124.

Corresponding to the sliding recesses 125, the two mylar layers 170, made of a plastic material, are disposed in the bottom surface of the two second regions 112 of the base plate 110. In this embodiment, as shown in FIG. 4A, the thickness of the mylar layers 170 are equal to the height difference H between the first region 111 and the two second regions 112.

While assembling the press button 100, the pivot pins 1542 are disposed in the bores 1211 so that the cap 150 is pivotally connected to the link member 120. The two protrusions of the first ends 161 of the two stoppers 160 pivot in the bores 1551 of the stopper holders 155. As shown in FIG. 5, the main body 163 is disposed in the channel 124, and the second end 162 of the stopper 160 is slidably disposed in the sliding recess 125 of the link member 120. It is noted that the second end 162 of the stopper 160 is a free end and is not directly connected to other components.

Through the connections of the pivot holders 121 and the pivot members 154, the cap 150 is constrained. Specifically, since a distance between the inner surfaces of the two retaining plates 1541 is substantially equal to a distance between the outer surfaces of the two pivot holders 121, the retaining plates 1541 are constrained by the pivot holders 121, i.e. a translatory displacement of the cap 150 along an X-axis direction is limited. Additionally, the pivot pins 1542 are connected to the bores 1211 so translatory displacement of the cap 150 along a Y-axis direction is limited.

Furthermore, the length of the link member 120 in the Y-axis direction is smaller than the length of the cap 150 in the Y-axis direction so that the first flange 152 and the second flange 153 do not overlap the link member 120 in a Z-axis direction.

Figure 4B:
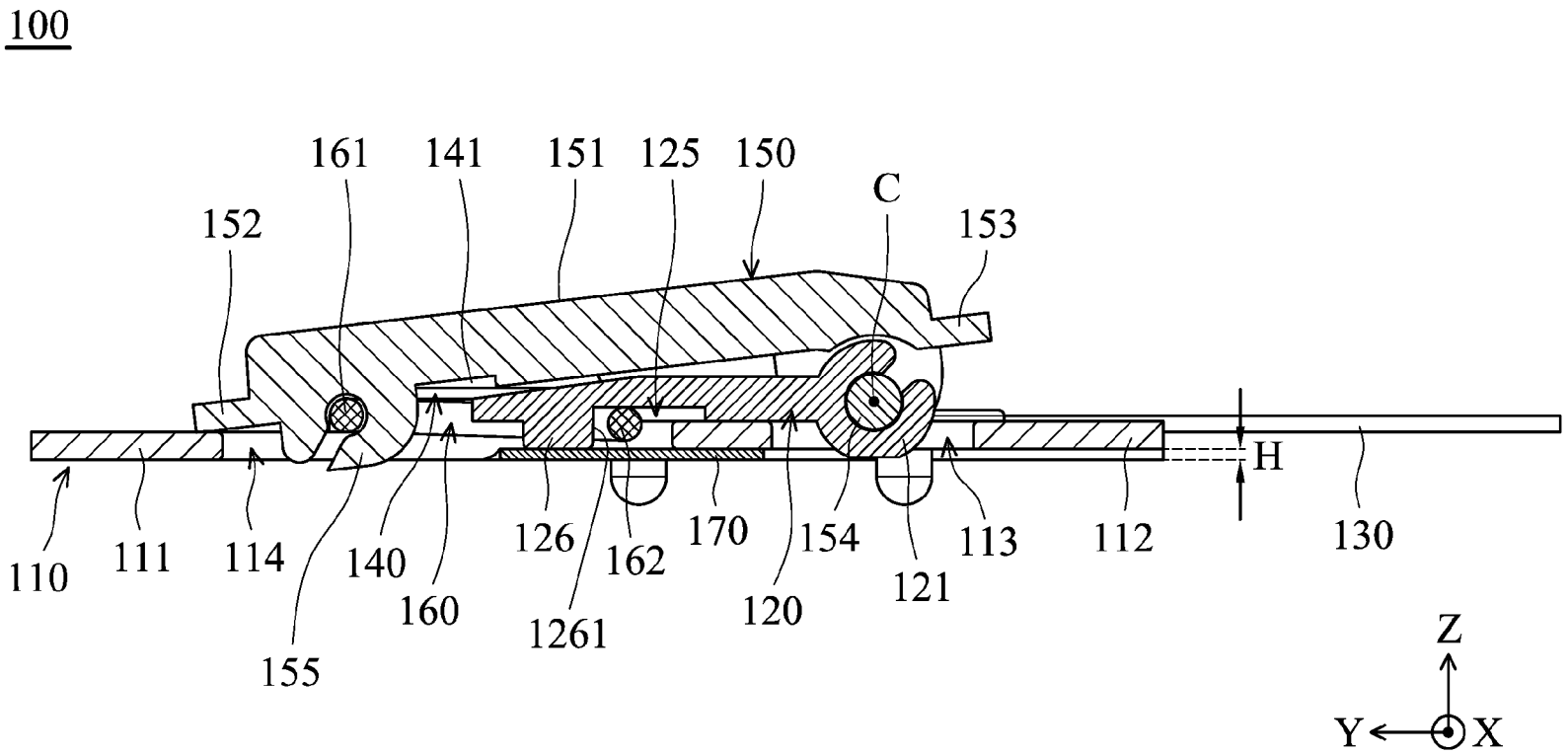
FIG. 4B is a cross-sectional view in accordance with an embodiment of the invention as the press button is pressed.

The working principle of the press button 100 of the present invention is described hereafter. Please refer to FIGS. 4A and 4B, wherein FIG. 4A is a cross-sectional view in accordance with an embodiment of the invention before the press button 100 is pressed, and FIG. 4B is a cross-sectional view in accordance with an embodiment of the invention as the press button 100 is pressed.

After assembly, a pivot axis C is defined at a common axis of the pivot pins 1542 and the bores 1211. It is noted that the pivot axis C is located between the first flange 152 and the second flange 153. Additionally, the bottom surface of the cap 150 abuts the upper portion 141 of the resilient member 140.

Before the press button 100 is pressed, due to support by the resilient member 140, a tension is produced along a Z-axis and the Y-axis by the stopper holders 155 of the cap 150 which pulls the second ends 162 of the stoppers 160 to abut the side walls 1261 of the retaining blocks 126. In this way, translatory displacement of the cap 150 along the Z-axis direction is limited by the stoppers 160.

After the pressing surface 151 is pressed by an external force, a moment occurs around the pivot axis C. Thus, the first flange 152 pivots around the pivot axis C and moves a predetermined displacement P. As shown in FIG. 4B, the first flange 152 abuts the first region 111 of the base plate 110, and the second ends 162 of the stoppers 160 slide in the sliding recesses 125. Meanwhile, the upper portion 141 of the resilient member 140 is deformed along the Z-axis direction, which enables the circuit board 130 to detect a pressing movement and produce a digital signal. Once the external force is released from the pressing surface 151, due to the resilient nature, the resilient member 140 provides a restoring force to push the cap 150 to its original position, as shown in FIG. 4A.

In some cases, after the cap 150 is pressed, a downward translatory displacement of the stoppers 160 causes the stoppers 160 to escape from the sliding recesses 125. To prevent this condition, the mylar layers 170 are disposed on the bottom surface of the base plate 110 to prevent the stoppers 160 from escaping from the sliding recesses 125.

Figure 6:
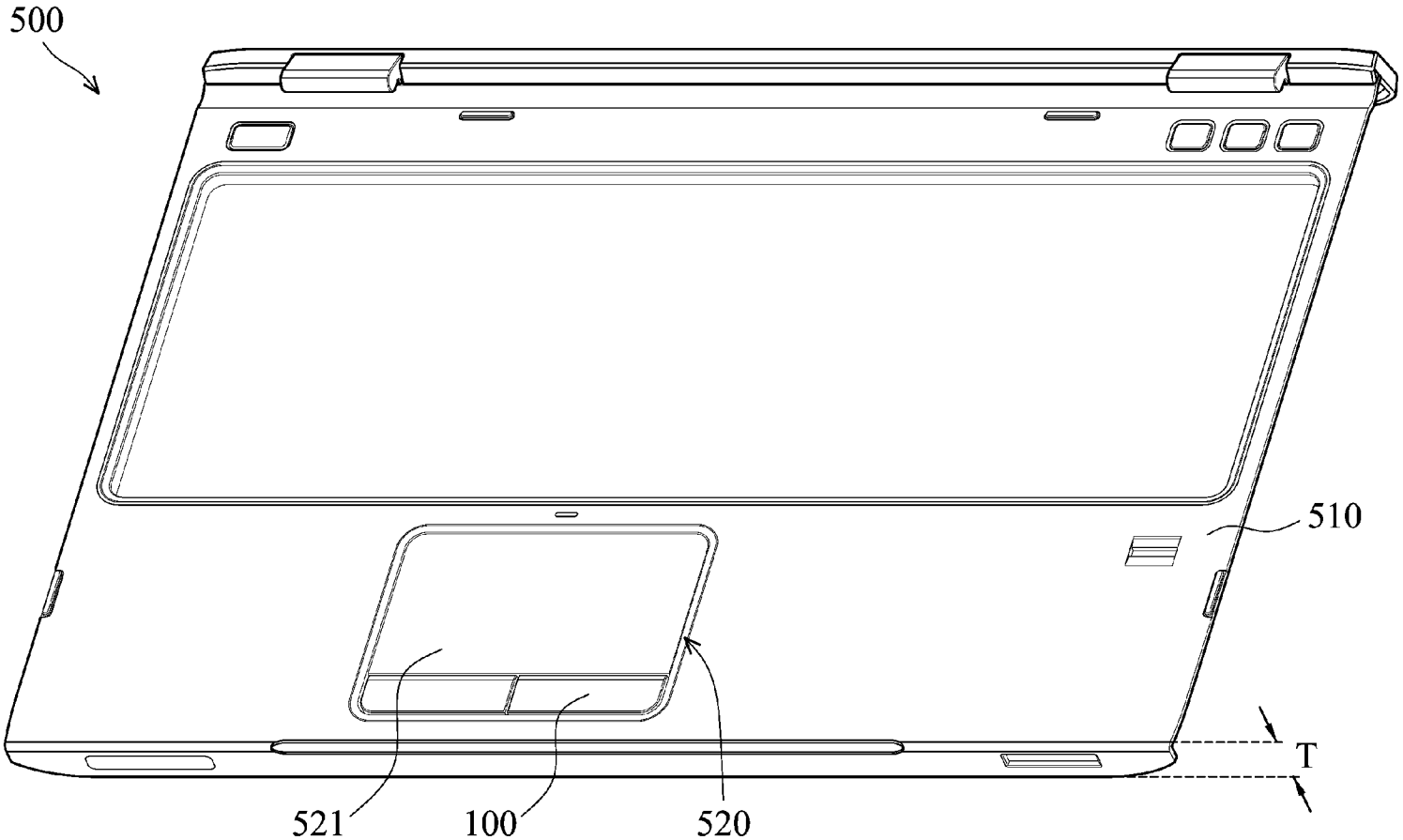
FIG. 6 illustrates a possible application of the invention when applied in a portable computer.

Referring to FIG. 6, wherein FIG. 6 illustrates a possible application of the invention when applied in a portable computer 500. The portable computer 500 includes a housing 510 and a control unit 520. The control unit 520 is connected to the upper surface of the housing 510 and includes a touch panel 521 and two press buttons 100. The touch panel 521 detects a movement of a finger and produces a digital signal, and the press buttons 100 detect a finger pressing movement and produces a digital signal.

As noted above, the thickness of each component is of great concern when designing the portable computer 500. Accordingly, the press button 100 with a thickness T successfully meets the requirement of the portable computer 500. Thus, the press button 100 of the present invention, when operated in a pivotal swinging manner, can replace the conventional press button which moves vertically.

Features of the invention are described by the above descriptions. The assembly operations of the press button of the present invention are simplified by reducing the number of necessary components required thereof and further reducing weight.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A press button, comprising:

a base plate;

a link member, having at least one sliding recess and disposed on the base plate;

a cap, pivoting on the link member; and at least one stopper, having a first end and a second end, wherein the first end pivots on the cap and the second end is slidably disposed in the sliding recess.

2. The press button as claimed in claim 1, wherein the cap further comprises a pivot member, and the link member further comprises a pivot holder disposed on the pivot member.

3. The press button as claimed in claim 2, wherein the cap further comprises a stopper holder on a side thereof opposing the pivot holder, and the first end of the stopper is disposed in the stopper holder.

4. The press button as claimed in claim 3, wherein, adjacent to the stopper holder, the cap further comprises a flange arranged to pivot around a pivot axis of the pivot member and abut abutting the base plate when the cap is pressed by an external force.

5. The press button as claimed in claim 2, wherein the base plate further comprises a through hole, and the pivot holder is received in the through hole.

6. The press button as claimed in claim 2, further comprising a resilient member, wherein the link member further comprises an opening, and the resilient member is received in the opening.

7. The press button as claimed in claim 6, wherein the resilient member is made of rubber.

8. The press button as claimed in claim 1, wherein the link member further comprises a retaining block, and the retaining block is adjacent to the sliding recess and is disposed on a bottom surface of the link member.

9. The press button as claimed in claim 1, wherein the sliding recess is formed at a bottom surface of the link member, and the link member further comprises a channel adjacent to the sliding recess, wherein the stopper is disposed in the channel.

10. The press button as claimed in claim 9, wherein, corresponding to an outward direction of the channel, the link member further comprises a retaining block which is disposed on a bottom surface of the link member and is adjacent to the sliding recess.

11. The press button as claimed in claim 1, wherein the link member further comprises a mylar layer, and the mylar layer corresponds to the sliding recess disposed on the base plate.

12. The press button as claimed in claim 1, wherein the base plate further comprises a first region and a second region connected to the first region and protruded from the first region, wherein the cap is arranged to abut the first region when the cap is pressed by an external force, and the link member is disposed on the second region.

13. The press button as claimed in claim 1, further comprising a circuit board disposed on the base plate, and a resilient member disposed on a surface of the circuit board.

14. The press button as claimed in claim 13, wherein the resilient member is made of rubber.

15. A portable electronic device, comprising:

a housing;

a control unit, connected to the housing; and a press button, disposed on the control unit, comprising:

a base plate;

a link member, having at least one sliding recess, disposed on the base plate;

a cap, pivoting on the link member; and at least one stopper, having a first end and a second end, wherein the first end pivots on the cap and the second end is slidably disposed in the sliding recess.

16. The portable electronic device as claimed in claim 15, wherein the cap further comprises a pivot member, and the link member further comprises a pivot holder disposed on the pivot member.

17. The portable electronic device as claimed in claim 16, wherein the cap further comprises a stopper holder on a side thereof opposing the pivot holder, and the first end of the stopper is disposed in the stopper holder.

18. The portable electronic device as claimed in claim 17, wherein, adjacent to the stopper holder, the cap further comprises a flange arranged to pivot around a pivot axis of the pivot member and abut the base plate when the cap is pressed by an external force.

19. The portable electronic device as claimed in claim 15, wherein the link member further comprises a retaining block, and the retaining block is adjacent to the sliding recess and is disposed on a bottom surface of the link member.

* * * * *